United States Patent [19]

Matsuda et al.

[11] 4,450,694

[45] May 29, 1984

[54] WARP-KNIT STRINGER TAPE FOR SLIDE FASTENER

[75] Inventors: Yoshio Matsuda, Uwano Nyuzen; Masahiko Hata, Tokyo; Toru Ogihara, Funabashi, all of Japan

[73] Assignee: Yoshida Kogyo K.K., Tokyo, Japan

[21] Appl. No.: 328,362

[22] Filed: Dec. 7, 1981

[30] Foreign Application Priority Data

Dec. 9, 1980 [JP] Japan ..... 55-176403

[51] Int. Cl.[3] ..... D04B 23/08; D04B 23/10

[52] U.S. Cl. ..... 66/193; 24/393; 66/195

[58] Field of Search ..... 66/190, 192, 193, 195; 24/215.16 C, 205.15 R, 205.16 R

[56] References Cited

U.S. PATENT DOCUMENTS 2,652,705 9/1953 Weinberg ..... 66/193
3,926,017 12/1975 Matsuda ..... 66/195
3,996,773 12/1976 Matsuda ..... 66/195 X
4,051,579 10/1977 Heimberger ..... 66/195 X

FOREIGN PATENT DOCUMENTS 51-135709 11/1976 Japan ..... 66/195 X
52-24161 2/1977 Japan ..... 66/195 X

*Primary Examiner*—Ronald Feldbaum
*Attorney, Agent, or Firm*—Hill, Van Santen, Steadman & Simpson

[57] ABSTRACT

A warp-knit stringer tape for a slide fastener comprises an elongate first web for supporting along one longitudinal edge thereof a row of fastener coupling elements, an elongate second web spaced transversely from the first web with a wale-free coarse region therebetween which is remote from the coupling-element-supporting side of the first web, and a connector thread interconnecting the first and second webs across the wale-free coarse region. The second web is double knit as a round braid-like structure which is compact and rigid.

4 Claims, 2 Drawing Figures

WARP-KNIT STRINGER TAPE FOR SLIDE FASTENER

BACKGROUND OF THE INVENTION

1. Field of the Invention

The present invention relates to a warp-knit stringer tape for slide fasteners suitable for use on knit fabrics.

2. Prior Art

A warp-knit stringer tape for slide fasteners has been proposed which has a wale-free coarse region extending between a pair of transversely spaced longitudinal warp-knit webs for venting air or for easy attachment to a knit fabric, there being a connector thread interconnecting the two webs across the wale-free coarse region. However, one of the webs, remote from the coupling-element-supporting tape edge, has a flat unstable structure having only an inadequate degree of rigidity, which can easily be twisted or otherwise deformed due to heat during the dyeing step of manufacture. With such stringer tape easy and proper attachment of the slide fastener to a knit fabric is difficult to achieve, at which time the stringer tape can hardly be put on a row of knitting needles of a linking machine or the like without obstruction. Further the stringer tape, when attached to a knit fabric, tends to become wavy or puckered, which is unsightly.

SUMMARY OF THE INVENTION

According to the present invention, a warp-knit stringer tape for slide fasteners includes a pair of longitudinal first and second warp-knit webs spaced transversely from one another with a wale-free coarse region therebetween and interconnected by a connector thread extending across the wale-free coarse region, the first web having a longitudinal beaded edge along which a row of fastener coupling elements is to be supported. The second web is composed of a plurality of threads double knit into a compact round braid-like structure and hence has an increased degree of rigidity.

It is accordingly an object of the invention to provide a warp-knit stringer tape for slider fasteners which is sufficiently resistive to a twist, particularly in a second web of the tape, thus enabling easy and proper attachment of the slide fastener to a knit fabric, at which time the stringer tape can be put on a row of knitting needles without obstruction.

Another object of the invention is to provide a warp-knit stringer tape for slide fasteners in which a second web of the tape has an increased degree of uniformity and strength so that the tape when attached to a knit fabric is kept sightly without becoming wavy or puckered.

Many other advantages, features and additional objects of the present invention will become manifest to those versed in the art upon making reference to the detailed description and the accompanying drawings in which two preferred embodiments incorporating the principles of the present invention are shown by way of illustrative example.

DETAILED DESCRIPTION

Figure 1:
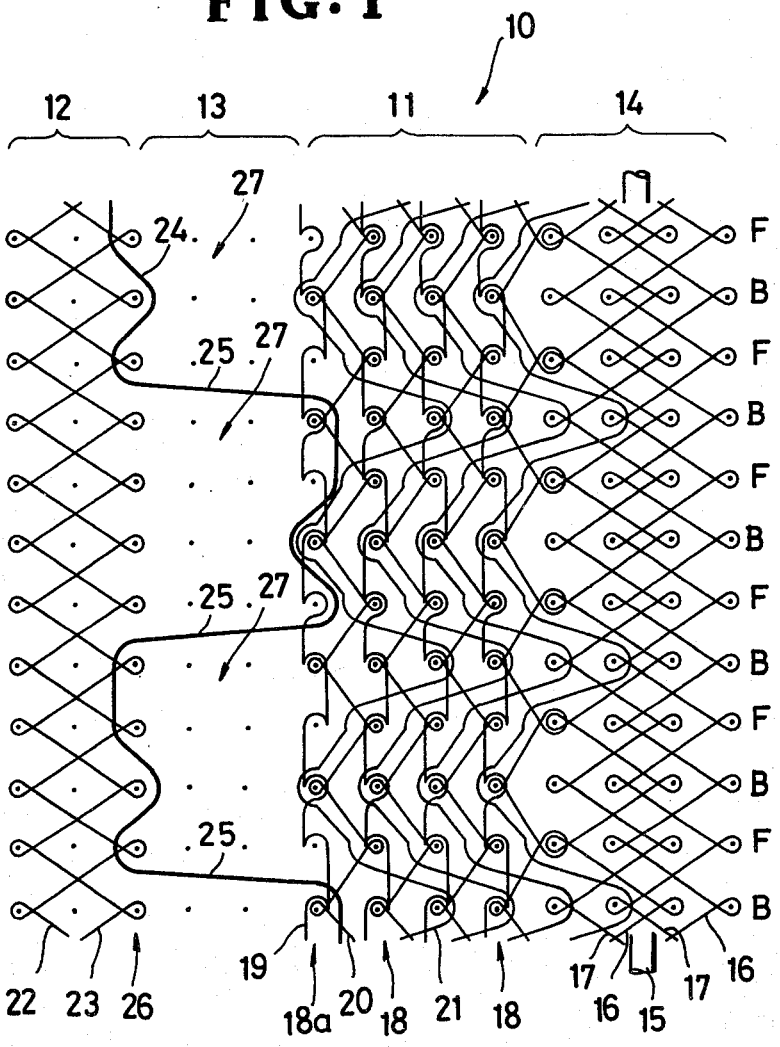
FIG. 1 is a point diagram for a warp-knit fabric structure of a stringer tape according to a first embodiment of the present invention.

FIG. 1 illustrates a warp-knit stringer tape 10 for slide fasteners suitable for use on knit fabrics. The warp-knit stringer tape 10 is made on a knitting machine having a pair of front and back needle beds F,B and hence has a double knit or double-faced structure. The stringer tape 10 has a pair of first and second longitudinal warp-knit webs 11,12 spaced transversely from one another with a wale-free coarse region 13 therebetween which is devoid of two wales. The wale-free coarse region 13, however, may be varied in width by selecting a suitable number of wales to be omitted therefrom.

The stringer tape 10 also has a beaded edge portion 14 along which a row of coupling elements (not shown) is to be mounted. The beaded edge portion 14 includes a core thread 15 laid in a pattern of 0-0/0-0, tricot stitches 16 having a pattern of 2-0/4-6, and tricot stitches 17 having a pattern of 4-6/2-0.

The first warp-knit web 11, which is contiguous to the beaded edge portion 14, has a plurality of longitudinal wales 18 which include chain stitches 19 having a pattern of 2-0/0-2/0-2. The first web 11 also includes tricot stitches 20 having a pattern of 2-4/2-0, and a plurality of weft threads 21 laid in a pattern of 0-0/4-4/6-6/4-4.

The first and second warp-knit webs 11,12 are interconnected by a connector thread 24 laid in a pattern of 0-0/8-8/6-6/8-8/8-8/0-0/2-2/0-0. The connector thread 24 thus laid in has ladder-like parallel portions 25 spaced at equal intervals along and extending between the innermost opposite wales **18*a*,26 of the two webs 11,12 transversely across the wale-free coarse region 13, thereby providing a succession of substantially rectangular openings 27 along the wale-free coarse region 13**.

The second warp-knit web 12 has a compact round braid-like structure which includes tricot stitches 22 having a pattern of 4-6/2-0, and tricot stitches 23 having a pattern of 2-0/4-6. The second web 12 thus constructed has a sufficient degree of uniformity and rigidity and hence is resistive to a twist or otherwise deformation due to heat during the dyeing step of manufacture, making the slide fastener capable of being attached to a knit fabric easily and properly, at which time the stringer tape 10 can be put on a row of knitting needles of a linking machine or the like without obstruction. Further, the stringer tape 10 when attached to a knit fabric would keep sightly without becoming wavy or puckered.

Figure 2:
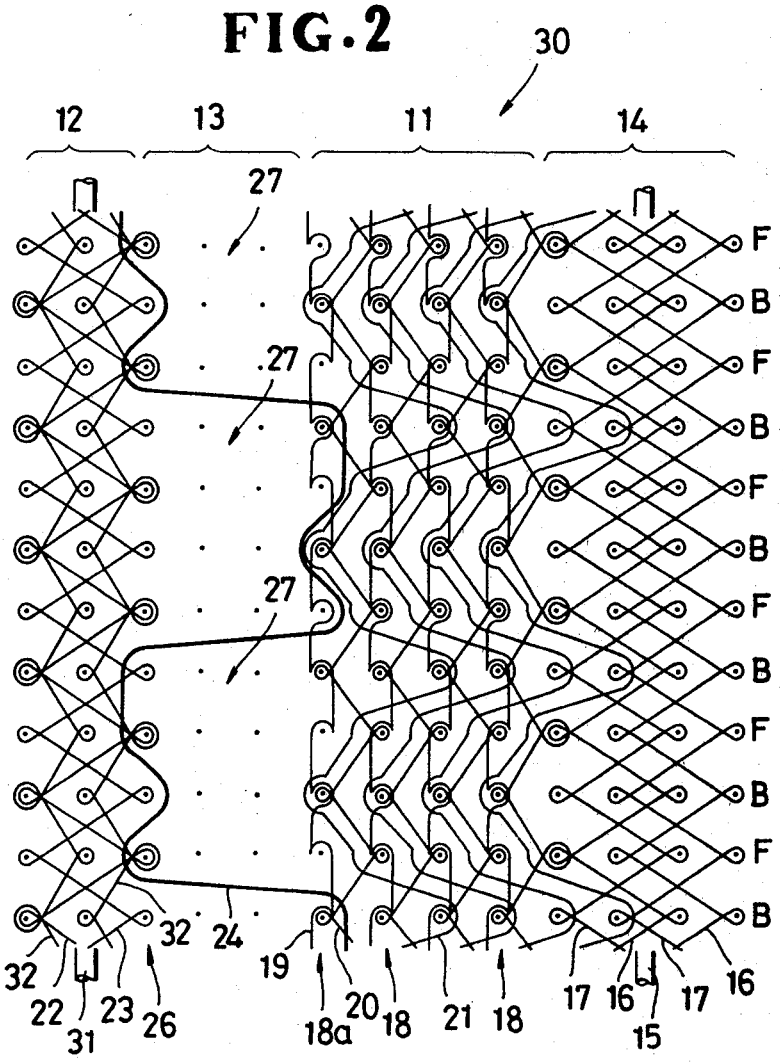
FIG. 2 is a point diagram for a warp-knit fabric structure of a modified stringer tape according to a second embodiment.

FIG. 2 illustrates a modified stringer tape 30 according to a second embodiment. The stringer tape 30 has a double knit structure similar to that of the stringer tape 10 of FIG. 1 and is different therefrom only in that the second web 12 includes, in addition to the tricot stitches 22,23, a core thread 31 laid in a pattern of 0-0/0-0, and tricot stitches 32 having a pattern of 2-4/2-0. The tricot stitches 22,23,32 jointly surround the core thread 31 and grip it firmly, thus making the second web 12 compact and rigid. With the stringer tape 30, the same results as the embodiment of FIG. 1 can be achieved.

In any of the embodiments of FIGS. 1 and 2, the first web 11 may have an ordinary knit structure as an alternative to the double knit structure.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A double warp-knit stringer tape for a slide fastener suitable for a knit fabric and having a pair of rows of coupling elements, comprising:

(a) an elongate first web for supporting along one longitudinal edge thereof one coupling element row of the slide fastener;

(b) an elongate second web for being joined to the knit fabric, said web being spaced transversely from said first web with a wale-free coarse region therebetween which second web and coarse region are both remote from said coupling element supporting edge of said first web; and (c) a connector thread interconnecting said first and second webs across said wale-free coarse region;

(d) said second web being double knit as a compact round braid-like structure for being attached to and stabilizing the knit fabric.

2. A warp-knit stringer tape according to claim 1, said second web including tricot stitches having a pattern of 4-6/2-0, and tricot stitches having a pattern of 2-0/4-6.

3. A warp-knit stringer tape according to claim 2, said second web further including tricot stitches having a pattern of 2-4/2-0.

4. A warp-knit stringer tape according to claim 3, said second wep further including a core thread laid in a pattern of 0-0/0-0.

* * * * *